US007413491B2

(12) United States Patent
Kawamoto

(10) Patent No.: US 7,413,491 B2
(45) Date of Patent: Aug. 19, 2008

(54) MARINE VESSEL PROPULSION STRUCTURE AND MARINE VESSEL DRIVING APPARATUS

(75) Inventor: Koji Kawamoto, Aichi (JP)

(73) Assignee: Ark System Corporation, Nagoya-shi, Aichi (JP)

( * ) Notice: Subject to any disclaimer, the term of this patent is extended or adjusted under 35 U.S.C. 154(b) by 91 days.

(21) Appl. No.: 11/335,994

(22) Filed: Jan. 20, 2006

(65) Prior Publication Data

US 2006/0172630 A1 Aug. 3, 2006

(30) Foreign Application Priority Data

Jan. 31, 2005 (JP) ..... 2005-023634

(51) Int. Cl.

| | |
|---|---|
| ***B63H 20/14*** | (2006.01) |
| *B63H 20/32* | (2006.01) |
| *B63H 21/36* | (2006.01) |
| *B63H 5/07* | (2006.01) |
| *B63H 5/10* | (2006.01) |
| *B63H 23/34* | (2006.01) |

(52) U.S. Cl. ..... 440/75; 440/76; 440/78; 440/79; 440/82; 440/83

(58) Field of Classification Search ..... 440/53, 440/56, 75–83, 86

See application file for complete search history.

(56) References Cited

U.S. PATENT DOCUMENTS

| | | | | | |
|---|---|---|---|---|---|
| 2,569,346 | A | * | 9/1951 | Shively | 416/121 |
| 2,705,468 | A | * | 4/1955 | Dix | 416/121 |
| 2,936,730 | A | * | 5/1960 | Patty, Jr. | 440/56 |
| 3,112,728 | A | * | 12/1963 | Krause | 440/75 |
| 3,261,229 | A | * | 7/1966 | Russell et al. | 74/665 GB |
| 3,954,083 | A | * | 5/1976 | Frostrom | 440/61 R |
| 5,215,486 | A | * | 6/1993 | Rizikow | 440/79 |
| 5,413,512 | A | * | 5/1995 | Belenger | 440/74 |

FOREIGN PATENT DOCUMENTS

| | | | |
|---|---|---|---|
| JP | 52-137258 | U | 4/1976 |
| JP | 57-70999 | U | 10/1980 |
| JP | 58-40498 | U | 3/1983 |
| JP | 62-220720 | | 9/1987 |
| JP | 05-058389 | | 3/1993 |

OTHER PUBLICATIONS

Japanese Notice of the reason for refusal, dated May 9, 2007.
Japanese Notice of the reason for refusal, dated Oct. 31, 2007.

* cited by examiner

*Primary Examiner*—Lars A Olson
*Assistant Examiner*—Daniel V Venne
(74) *Attorney, Agent, or Firm*—Peter Ganjian

(57) ABSTRACT

In an outboard drive or an inboard-outboard drive, power generated by a single engine is transmitted in left and right directions from a main drive shaft, thereby finally causing left and right propellers to be rotated, the left and right propellers being arranged about the main drive shaft so as to be spaced apart from the main drive shaft at approximately equal distances from the main drive shaft and facing a travel direction of a marine vessel, the outboard drive or inboard-outboard drive being provided with left and right shift cam assemblies for causing rotation situations of the propellers to be controlled dependently from each other, the rotation situations including normal rotation, reverse rotation and non-rotation situations of the propellers.

6 Claims, 6 Drawing Sheets

FORWARD MOVEMENT ⟷ REARWARD MOVEMENT

MARINE VESSEL PROPULSION STRUCTURE AND MARINE VESSEL DRIVING APPARATUS

BACKGROUND OF THE INVENTION

1. Field of the Invention

The present invention relates to a marine vessel propulsion structure and marine vessel driving apparatus which causes a marine vessel to be propelled using a plurality of propellers.

2. Description of the Related Art

Hitherto, in order to facilitate improving of maneuverability of a marine vessel such as a boat or the like upon steering of the marine vessel, two so-called outboard drives or inboard-outboard drives which are each provided with a single engine and propellers driven by the single engine are installed at predetermined locations of a rear portion of the marine vessel.

Moreover, there is known a tandem propeller mounting structure in which two forward and rearward propellers constituting a tandem propeller system are mounted on a single propeller shaft (for example, Japanese Patent Application Laid-Open No. Hei. 5-58389).

Also, there is known a structure in which a plurality of screws are mounted on a single shaft (for example, Japanese Utility Model Application Laid-Open No. Sho. 58-40498).

In a case where, like the conventional marine vessel, a marine vessel is provided with two outboard drives or the like, there are raised problems that much fuel is consumed for driving two engines and fuel economy is therefore poor, a poor balance of the marine vessel is offered due to an increased weight of the rear portion of the marine vessel, and maintenance cost of the marine vessel is increased.

Furthermore, in a marine vessel employing the structure in which the plurality of propellers are mounted on the single propeller shaft like the above-mentioned prior art structure, turning-around of the marine vessel is performed with resort to a rudder, so that it is hard to delicately steer the marine vessel. For example, in a case where an advancing direction of the marine vessel is controlled in a narrow harbor or the like, a high-level steering technique is required.

SUMMARY OF THE INVENTION

The present invention has been made with a view to overcoming the foregoing problems of the prior art structures.

It is therefore an object of the present invention to provide a marine vessel propulsion structure and marine vessel driving apparatus which facilitates steering of a marine vessel such as the turning-around of the marine vessel, the swinging-around of the marine vessel, etc., ensures keeping of a balance of the marine vessel during the travel of the marine vessel, ensures good fuel economy for driving the marine vessel, and facilitates saving of maintenance cost of the marine vessel.

In order to attain the above-mentioned object, a marine vessel propulsion structure according to the present invention comprises a main drive shaft adapted to receive predetermined power and rotate, sub-drive shafts disposed in several directions relative to the main drive shaft, a power transmission mechanism for transmitting power from the main drive shaft toward the several directions and rotating the sub-drive shafts by the transmitted power, propeller shafts respectively associated with the sub-drive shafts, propellers mounted on the propeller shafts, a propeller rotating mechanism for transmitting the power transmitted to the sub-drive shafts to the propeller shafts and the propellers, to thereby cause the propellers to be rotated, and shift controller unit for causing rotation situations of the propellers to be controlled independently from each other.

In the above-mentioned marine vessel propulsion structure according to the present invention, the power transmission mechanism transmits the power to the several directions from the main drive shaft which receives the predetermined power and is rotated. The transmitted power causes the sub-drive shafts arranged in the several directions to be rotated. In the propeller rotating mechanism, the power transmitted to the sub-drive shafts is transmitted to the propeller shafts associated with the sub-drive shafts and the propellers, whereby the propellers are rotated. Moreover, the shift controller unit causes rotation situations of the propellers to be controlled independently from each other per propeller.

That is, in the marine vessel propulsion structure according to the present invention, several sets of the propellers and propeller shafts are employed, and the power transmitted to the main drive shaft is transmitted through the sub-drive shafts associated with the set of the propellers and propeller shafts, so that the number of the engine generating an original power may be one. Moreover, the propellers are not arranged on a single shaft but are arranged at locations different from each other, so that the rotation situations of the propellers can be controlled per propeller. Therefore, the structure according to the present invention ensures that steering of the marine vessel such as turning-around of the marine vessel is easily performed without resort to handling of a rudder.

Furthermore, in the structure according to the present invention, the main drive shaft may be provided at a predetermined portion thereof with a bevel gear and the sub-drive shafts may be provided with bevel gears at portions thereof that are adjacent the main drive shaft, the bevel gears of the sub-drive shafts being meshed with the bevel gear of the main drive shaft.

That is, the main drive shaft and the sub-drive shafts are connected to one another through the bevel gears, so that the rotating power of the main drive shaft can be positively transmitted to the sub-drive shafts. Therefore, the transmitted power is transmitted to the propeller shafts and propellers that are associated with the respective sub-drive shafts. More particularly, it is conceivable that one bevel gear is mounted on an end of the main drive shaft, bevel gears are mounted on ends of the sub-drive shafts that are adjacent the end of the main drive shaft, and the bevel gears of the sub-drive shafts are meshed with the bevel gear of the main drive shaft.

If consideration to a balance of a marine vessel and maneuverability of the marine vessel is given, it is preferable that the propellers are arranged symmetrically about the main drive shaft in the left and right directions. Therefore, in a preferred embodiment of the present invention, two propellers may be arranged at locations spaced apart in the left and right directions from the main drive shaft at approximately equal distances, with the propeller shafts thereof extending in substantially parallel with each other. Furthermore, the two propellers are designed such that their normal rotation for advancing the marine vessel is opposite to each other.

Therefore, the selection of the normal rotation, reverse rotation and non-rotation situations of the two propellers is controlled, so that the steering of the marine vessel such as the turning-around of the marine vessel and the swinging-around of the marine vessel on the spot can be executed by propulsive power generated by the propellers and the maneuverability of the marine vessel is therefore improved. Meanwhile, generally speaking, there is a possibility that the marine vessel in travel will list due to torques for rotating the propellers. However, in the structure according to the present invention, the torques for rotating the respective propellers are applied to in directions opposite to each other at the time when the marine vessel is straightly advanced, so that the listing of the marine vessel is cancelled and the marine vessel is therefore well-balanced at the time when the marine vessel is straightly advanced.

Moreover, in a preferred embodiment according to the present invention, the structure may further include a forward gear for causing corresponding propeller to be rotated in a normal rotation direction and a rearward gear for causing corresponding propeller to be rotated in a reverse direction, the forward and rearward gears being arranged between corresponding sub-drive shaft and propeller shaft. The shift controller unit is adapted to execute switching in such a manner to cause one of the forward and rearward gears to be activated or cause both of the forward and rearward gears to be inactivated.

In the above structure, the shift controller unit performs the switching in such a manner to cause the one of the forward and rearward gears provided between the sub-rive shaft and the propeller shaft to be activated or cause the both of the forward and rearward gear as discussed above, to thereby control the rotation situations of the respective propellers. According to the structure, it is possible to easily control the selection of the normal rotation, reverse rotation and non-rotation situations of the respective propellers.

While the present invention is discussed above from the viewpoint in which the supplied power is transmitted to the respective propellers and the rotation situations of the respective propellers are controlled, the technical idea of the present invention can be applied to a marine vessel driving apparatus including an engine.

Therefore, in accordance with a further aspect of the present invention, there is provided a marine vessel driving apparatus which comprises a single engine for generating predetermined power, a main drive shaft adapted to be rotated by the power produced by the engine and transmit the power in several directions relative to the main drive shaft, sub-drive shafts arranged in the several directions, a power transmission mechanism for causing the sub-drive shafts to be rotated by the power transmitted in the several directions, propeller shafts and propellers associated with the respective sub-drive shafts, a propeller rotating mechanism for transmitting the power transmitted to the sub-drive shafts to the propeller shafts and the propellers and rotating the propellers, and shift controller unit for causing rotation situations of the propellers to be controlled independently from each other.

In the above structure, the same operation and effects as achieved in the above marine vessel propulsion structure can be achieved. Particularly, the number of the engine employed is one in spite of the number of the propellers, so that, as compared to the case where several outboard drives etc. each provided with an engine are installed and propellers are rotated by the outboard drives, the structure of the present invention is superior in that fuel consumption is restrained, a good balance of a marine vessel is kept and maintenance cost of the marine vessel is reduced.

As discussed above, according to the present invention, the power transmitted to the single main drive shaft is transmitted to the separate propeller shafts to thereby cause the propellers to be rotated, the rotation situations of the respective propellers are controlled independently from each other, so that the number of the engine installed may be one, the maneuverability and balance of the marine vessel can be improved, the cost of fuel consumed for driving the marine vessel can be reduced and the maintenance cost of the marine vessel can be also reduced.

BRIEF DESCRIPTION OF THE DRAWINGS

The above and other objects and many of the attendant advantages of the present invention will be readily appreciated as the same becomes better understood by reference to the following detailed description when considered in connection with the accompanying drawings, in which like reference numerals denote the same parts throughout the Figures and wherein:

FIG. 2 is a schematic front elevational view of an internal structure of a lower casing, and the like;

FIG. 3 is a schematic top plan view of the internal structure of the lower casing, and the like;

DETAILED DESCRIPTION

Embodiments according to the present invention will be discussed hereinafter in the following order:

(1) First Embodiment;

(2) Second Embodiment; and (3) Summary.

(1) First Embodiment

Figure 1:
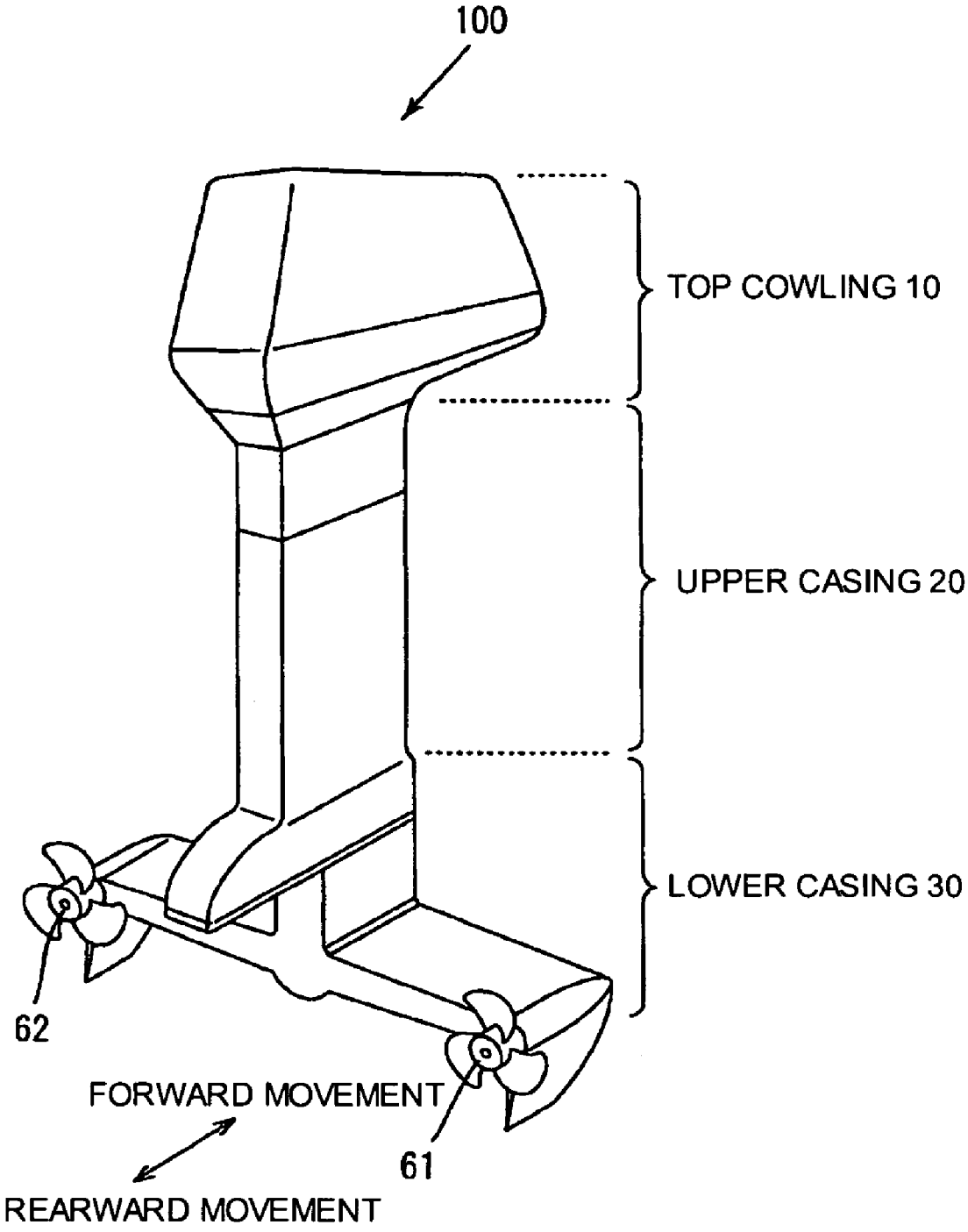
FIG. 1 is a schematic perspective view of an outboard drive according to the present invention.

FIG. 1 is a schematic perspective view illustrating an appearance of an outboard drive corresponding to a marine vessel driving apparatus according to the present invention.

The outboard drive 100 is arranged at a rear portion of a marine vessel such as a boat or the like so as to be well-balanced by causing a vertical center line of the outboard drive to be aligned with a center location of a longitudinal direction of the marine vessel. The traveling of the marine vessel on the water can be realized by rotation of propellers. The outboard drive includes a top cowling 10, an upper casing 20, a lower casing 30, and two right and left propellers 61, 62 exposed to the exterior on the both sides of a lower part of the lower casing 30, which are arranged in order from substantially above.

In an interior of the top cowling 10 of the outboard drive 100, a power unit including a single engine 11 (see FIG. 2), a starter motor, and like is housed. Moreover, a main drive shaft 40 (see FIG. 2) which is connected to the engine 11 extends from the top cowling 10 to the lower casing 30 through the upper casing 20, whereby the main drive shaft is supported thereto. Incidentally, as the engine 11, there may be employed various engines such as a two-cycle or four-cycle gasoline engine, a diesel engine and the like. Furthermore, according to the degree of a horsepower of the outboard drive 100, a fuel tank and a battery are housed within the cowling 10 or are installed at predetermined locations of the marine vessel.

In addition, an unshown cooling device, suction and exhaust device, lubrication system and the like are housed within the outboard drive 100.

Figure 2:
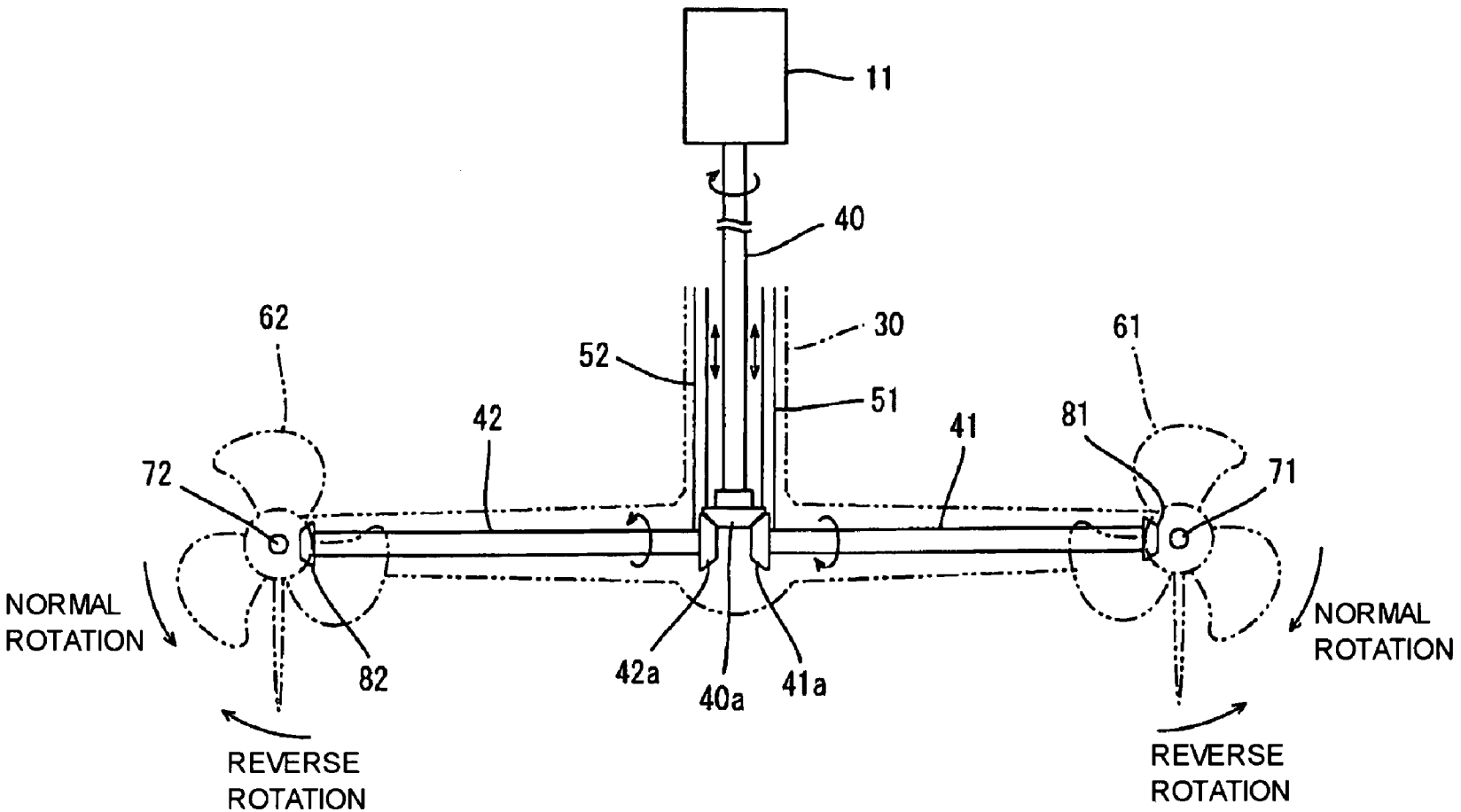

FIG. 2 is a schematic front elevational view of an internal structure of the outboard drive 100, in which the lower casing 30 is shown at a center location. In this Figure, the lower casing 30 and the right and left propellers 61, 62 are shown by chain double-dashed lines.

In this embodiment, the term "front" shall be given to mean a side which faces the outboard drive 100 as viewed from an rearward movement direction of the marine vessel in FIG. 1. The terms "right" and "left" shall be respectively used to denote the right and the left defined by the front.

As shown in FIG. 2, the main drive shaft 40 vertically extends in the lower casing 30 along a substantially center line of the lower casing 30 and supported to the lower casing 30. The main drive shaft 40 receives power generated by the engine 11, whereby the main drive shaft 40 is rotated in a fixed direction.

A sub-drive shaft 41 extends in a right direction from a location adjacent a lower end of the main drive shaft 40 and is substantially horizontally supported to the lower casing 30. Also, a sub-drive shaft 42 extends in a left direction from a location adjacent the lower end of the main drive shaft 40 and is substantially horizontally supported to the lower casing 30. The sub-drive shafts 41, 42 are designed so as to have the same length.

A propeller shaft 71 for rotating the right propeller 61 is arranged at a location adjacent an end of the sub-drive shaft 41 which is remote from an end of the sub-drive shaft 41 which is adjacent the main drive shaft 40. Also, a propeller shaft 72 for rotating the left propeller 62 is arranged at a location adjacent an end of the sub-drive shaft 42 which is remote from an end of the sub-drive shaft 42 which is adjacent the main drive shaft 40. The propeller shafts 71, 72 are supported so as to extend substantially horizontally toward a travel direction of the marine vessel (the forward/rearward movement direction in FIG. 1). That is, the propeller shaft 71 and the propeller shaft 72 are supported so as to extend in substantially parallel with each other.

In the above-mentioned structure, the power supplied by the engine 11 causes the main drive shaft 40 to be rotated. By the rotation of the main drive shaft 40, power is transmitted to the right and left propeller shafts 71, 72 through the right and left sub-drive shafts 41, 42, whereby the right and left propellers 61, 62 can be rotated.

More particularly, a bevel gear 40*a* for rotation with the main drive shaft 40 is mounted on the lower end of the main drive shaft 40, a bevel gear 41*a* for rotation with the right sub-drive shaft 41 is mounted on the end of the right sub-drive shaft 41 which is adjacent the lower end of the main drive shaft 40, and a bevel gear 42*a* for rotation with the left sub-drive shaft 42 is mounted on the end of the left sub-drive shaft 42 which is adjacent the lower end of the main drive shaft 40.

The bevel gear 40*a* of the main drive shaft 40 is meshed with the bevel gear 41*a* of the right sub-drive shaft 41 and the bevel gear 42*a* of the left sub-drive shaft 42. Generally speaking, bevel gears meshed with one another realize power transmission between two rotating shafts supported so as to extend in different directions (generally, two rotating shafts are perpendicular to each other). Therefore, the above-mentioned structure allows the right and left sub-drive shafts 41, 42 to receive the power from the main drive shaft 40 independently from each other, whereby the right and left sub-drive shafts 41, 42 are rotated in predetermined directions. An assembly comprising the bevel gears 40*a*, 41*a*, 42*a* may be regarded as a differential bevel gear unit.

Figure 3:
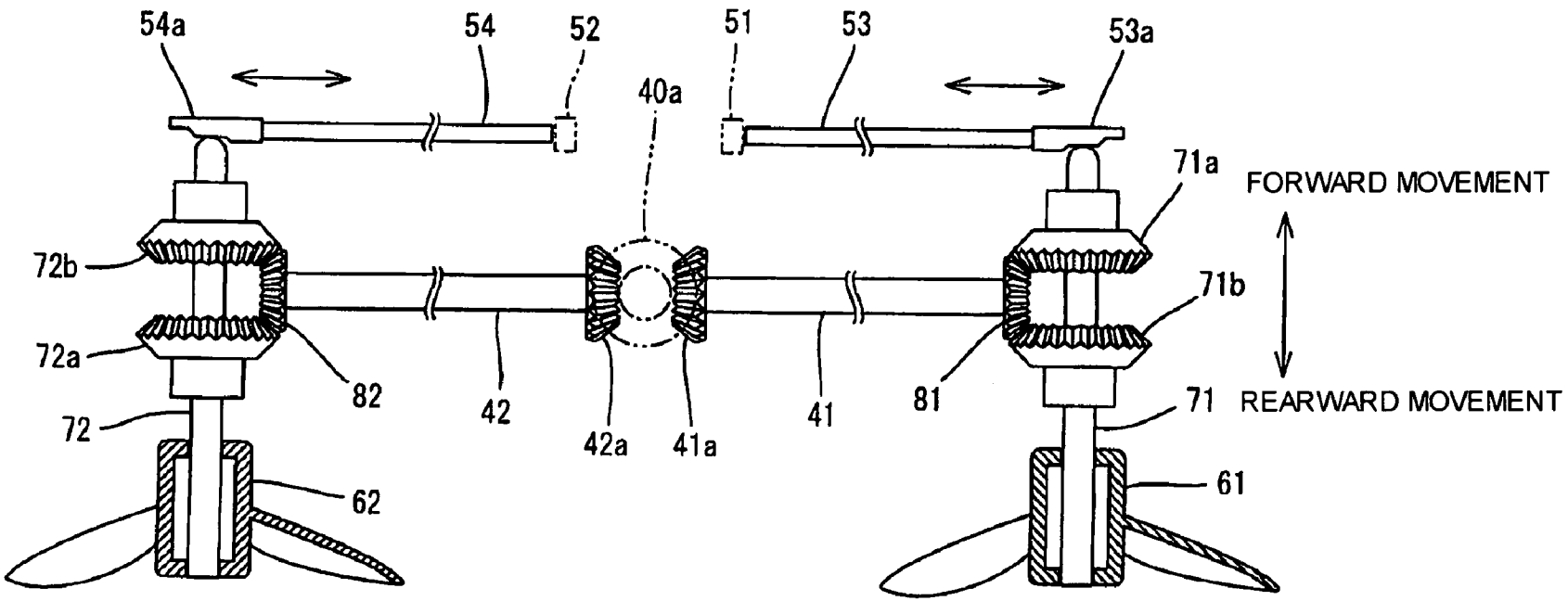

FIG. 3 is a schematic top plan view illustrating an internal structure of a lower part of the lower casing 30. Incidentally, the right and left propellers 61, 62 are shown in cross section.

At a substantially center location of FIG. 3, the bevel gear 40*a* mounted on the lower end of the main drive shaft 40 is shown by chain double-dashed lines. The sub-drive shafts 41, 42 etc. are shown on the right and left sides of the bevel gear 40*a*. A pinion gear 81, a forward gear 71*a* and a rearward gear 71*b* are arranged between the right sub-drive shaft 41 and the right propeller shaft 71. Moreover, a pinion gear 82, a forward gear 72*a* and a rearward gear 72*b* are arranged between the left sub-drive shaft 42 and the left propeller shaft 72. These gears serve as means to transmit the power of the rotating sub-drive shafts 41, 42 to the propeller shafts 71, 72 to thereby cause the right and left propellers 61, 62 to be rotated.

A vertical shift rod 51 is arranged in the forward direction from the main driveshaft 40 and on the right-hand. Also, a vertical shift rod 52 is arranged in the forward direction from the main drive shaft 50 and on the left-hand. The vertical shift rod 51 is contacted at a lower end thereof with an end of a horizontal shift rod 53 supported at the substantially same height in which the sub-drive shaft 41 is arranged. Similarly, the vertical shift rod 52 is contacted at a lower end thereof with an end of a horizontal shift rod 54 supported at the substantially same height in which the sub-drive shaft 42 is arranged. Incidentally, since the horizontal shift rods 53, 54 are arranged on the forward side from the sub-drive shafts 41, 42, they are not shown in FIG. 2.

A shift cam 53*a* and a shift cam 54*a* are respectively mounted on ends of the horizontal shift rods 53, 54 which are not contacted with the vertical shift rods 51, 52. That is, the vertical shift rod 51, the horizontal shift rod 53 and the shift cam 53*a* constitute a right-hand shift cam assembly, and the vertical shift rod 52, the horizontal shift rod 54 and the shift cam 54*a* constitute a left-hand shift cam assembly. As will be discussed in greater detail hereinafter, the shift cam assemblies are used to cause a shift change for the right propeller 61 and a shift change for the left propellers 62 to be executed independently from each other.

Incidentally, in the illustrated embodiment, as the right propeller 61 and the left propeller 62, there are employed propellers designed such that their normal rotation directions are opposite to each other. Now, the term "normal rotation direction" is given to mean such a direction as to produce thrust for causing the marine vessel to be moved forward. "reverse rotation direction" is given to mean such a direction as to produce thrust for causing the marine vessel to be moved rearward. That is, as shown in FIG. 2, the normal rotation direction of the right propeller 61 is the right direction and the normal rotation direction of the left propeller 62 is the left direction.

The principle of the transmission of power from the sub-drive shafts to the propellers will be discussed in greater detail hereinafter. Incidentally, the description of the principle will be made by reference to the structure for the right propeller 61 as the representative of the left and right propellers.

Figure 4:
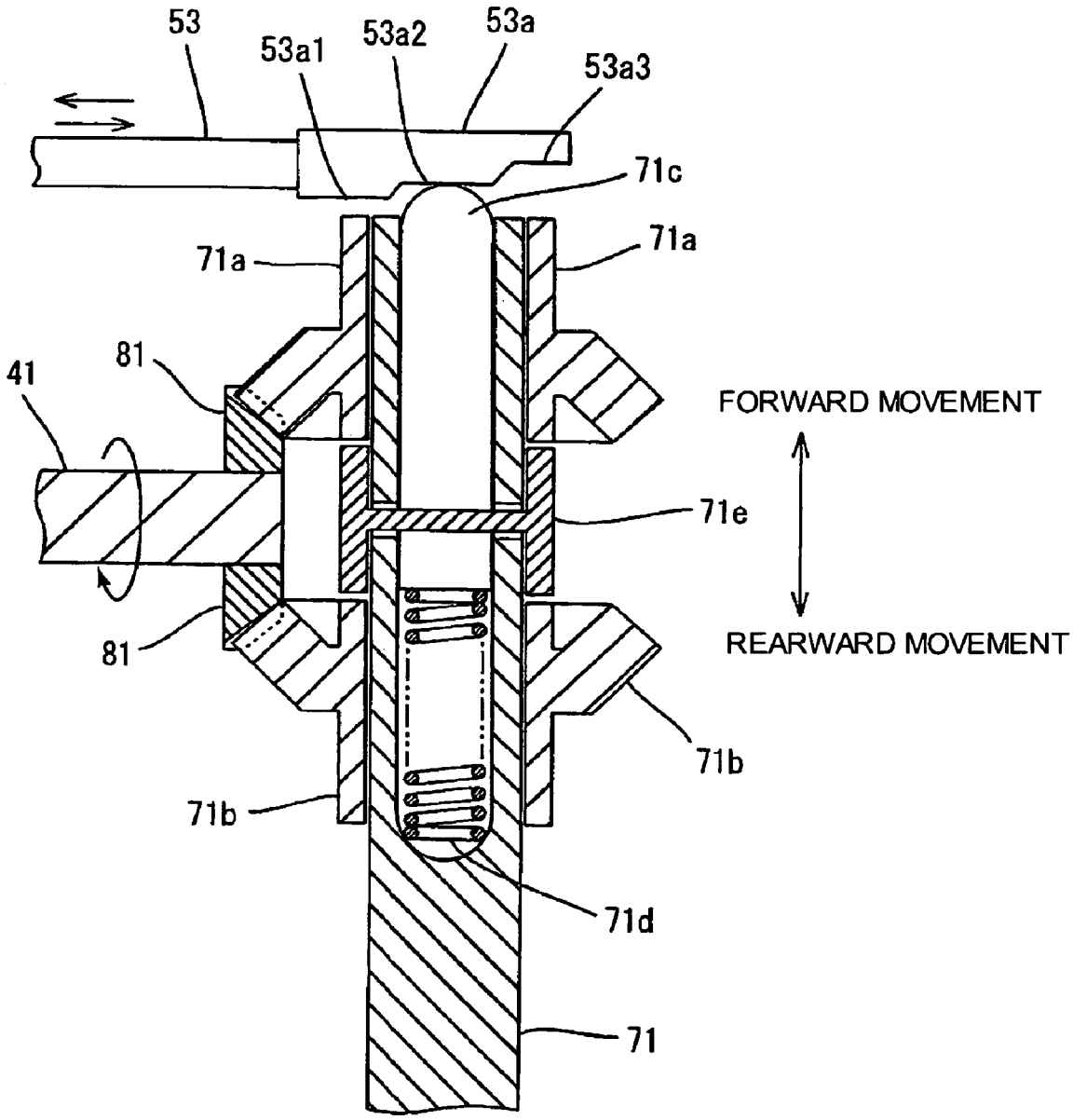
FIG. 4 is a schematic sectional view of a connection portion between a sub-drive shaft and a propeller shaft.

FIG. 4 is a schematic sectional view illustrating a connection portion between the sub-drive shaft 41 and the propeller shaft 71. In FIG. 4, hatching is partially omitted for ease of viewing.

The pinion gear 81 is a bevel gear-type gear and adapted to be rotated together with the sub-drive shaft 41. Moreover, both the forward gear 71*a* and the rearward gear 71*b* are in a condition where they are meshed with the pinion gear 81, so that, during the rotation of the pinion gear 81, the forward gear 71*a* and the rearward gear 71*b* receive power transmitted from the pinion gear 81 and are rotated. Of course, the forward gear 71*a* is rotated in the right direction (the normal rotation direction) and the rearward gear 71*b* is rotated in the left direction (the reverse rotation direction).

However, in a condition where the forward gear 71*a* and the rearward gear 71*b* are not meshed with a dog clutch 71*e* which will be discussed in greater detail hereinafter, they are idly rotated on the propeller shaft 71 and the rotation power of them is not transmitted to the propeller shaft 71. Therefore, in the case where the dog clutch 71*e* is meshed with neither the forward gear 71*a* nor the rearward gear 71*b*, the right propeller 61 is not rotated.

A shift plunger 71*c* and a spring 71*d* are provided in an interior of the propeller shaft 71. The shift plunger 71*c* is biased in a forward movement direction in FIG. 4 by the spring 71*d* and movable between the forward movement direction and a rearward movement direction by a predetermined distance. The dog clutch 71*e* can be displaced together with the shift plunger 71*c*.

That is, when the shift plunger 71*c* is displaced in the forward movement direction in FIG. 4, the dog clutch 71*e* is simultaneously brought to a condition where it is meshed with the forward gear 71*a*, so that the rotation power transmitted from the forward gear 71*a* having being rotated in the right direction is transmitted to the propeller shaft 71 through the dog clutch 71*e*. As a result, the right propeller 61 is rotated in the normal rotation direction, whereby forward thrust is produced. Conversely, when the shift plunger 71*c* is displaced in the rearward movement direction in FIG. 4, the dog clutch 71*e* is operatively meshed with the rearward gear 71*b*, so that the right propeller 61 is rotated in the reverse direction, whereby rearward thrust is produced.

The selection of the normal rotation situation, the reverse rotation situation and the neutral (non-rotation) situation can be realized by displacement of the shift cam 53*a* attached to the end of the horizontal shift rod 53.

The shift cam 53*a* is shaped in such a manner that a width of the shift cam 53*a* is gradually narrowed toward a tip end of the shift cam 53*a* in the forward and rearward movement direction in FIG. 4. Different width portions of the shift cam 53*a* constitute contact surfaces 53*a*1, 53*a*2, 53*a*3.

That is, when the shift cam 53*a* is displaced in a left and right direction in FIG. 4 and the narrowest contact surface 53*a*3 of the shift cam 53*a* is contacted with a tip end of the shift plunger 71*c*, the dog clutch 71*e* is pushed out toward the forward gear 71*a*, whereby the right propeller 61 is rotated in the normal rotation direction. Conversely, when the widest contact surface 53*a*1 of the shift cam 53*a* is contacted with the tip end of the shift plunger 71*c*, the dog clutch 71*e* is pushed in toward the rearward gear 71*b*, whereby the right propeller 61 is rotated in the reverse direction. The neutral situation is realized by making contact between the contact surface 53*a*2 of the shift cam 53*a* and the tip end of the shift plunger 71*c*.

Incidentally, a mechanism for causing the left propeller 62 to be rotated is basically constructed in the same manner as the above-mentioned mechanism for causing the right propeller 61 to be rotated is done. However, the normal rotation direction of the left propeller 62 is the left direction, so that the forward gear 72*a* is a gear which receives the rotation power of the sub-drive shaft 42 and pinion gear 82 and is then rotated in the left direction, and the rearward gear 72*b* is a gear which receives the rotation power of the sub-drive shaft 42 and pinion gear 82 and is then rotated in the right direction. When the left propeller is switched so as to be rotated in the normal rotation direction, the shift cam 54*a* is displaced in such a manner to allow the dog clutch to be operatively meshed with the forward gear 72*a*. Also, when the left propeller is switched so as to be rotated in the reverse direction, the shift cam 54*a* is displaced in such a manner to allow the dog clutch to be operatively meshed with the rearward gear 72*b*.

The displacement of the shift cams 53*a*, 54*a* can be realized by remote control in a cockpit of the marine vessel.

Figure 5:
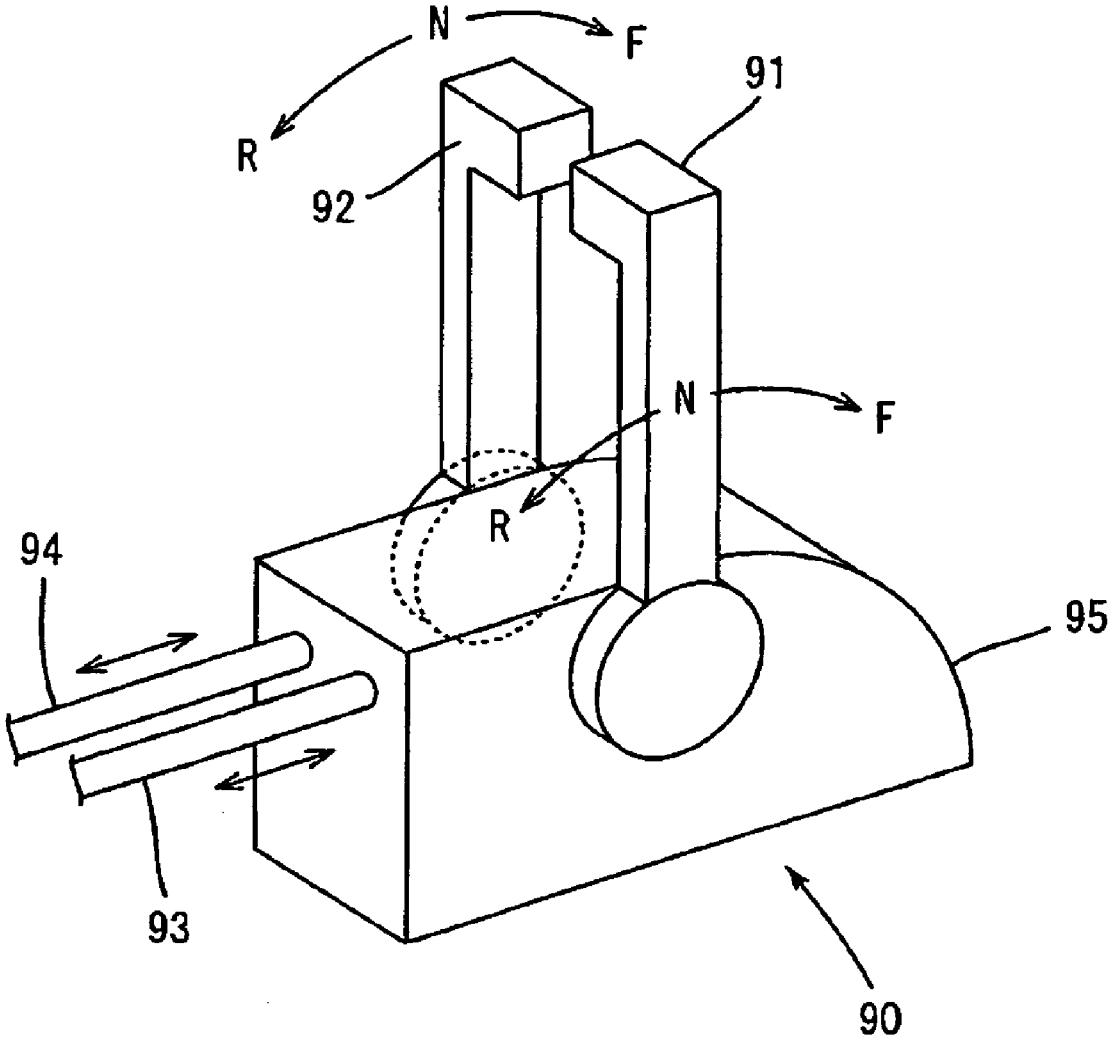
FIG. 5 is a schematic perspective view of a remote control system.

FIG. 5 is a schematic perspective view illustrating a remote control system 90 installed in the cockpit of the marine vessel equipped with the outboard drive 100. As shown in FIG. 5, the remote control system 90 comprises a body 95, and a shift lever 91 for executing a gear change of the right propeller 61 and a shift lever 92 for executing a gear change of the left propeller 62 which are provided on both sides of the body 95. As a structure for the remote control system 90, there may be employed, for example, a mechanical remote-control system. In this case, when an angle of the shift lever 91 is changed, a cable 93 that is connected at one end thereof to the shift lever 91 is drawn toward the body 95 or is pushed in a reverse direction.

The other end of the cable 93 is connected to one end of the above-mentioned vertical shift rod 51, so that the mechanical displacement of the cable 93 acts on the vertical shift rod 51. That is, the vertical shift rod 51 is vertically moved synchronously with the angle change of the shift lever 91 which is performed by an external control, and the horizontal shift rod 53 and the shift cam 53*a* are displaced horizontally synchronously with the vertical movement of the vertical shift rod 51. Therefore, by changing the angle of the shift lever 91, the contact surfaces of the shift cam 53*a* that contact the shift plunger 71*c* can be switched.

In this embodiment, when the angle of the shift lever 91 is inclined in a direction F (forward) in FIG. 5, the contact surface 53*a*3 is operatively contacted with the shift plunger 71*c* and the forward gear 71*a* is operatively meshed with the dog clutch 71*e*. When the shift lever 91 is inclined in a direction R (rearward), the contact surface 53*a*1 is operatively contacted with the shift plunger 71*c* and the rearward gear 71*b* is operatively meshed with the dog clutch 71*e*. Also, when the shift lever 91 is kept at an angle N (neutral), the contact surface 53*a*2 is contacted with the shift plunger 71*c* and the dog clutch 71*e* is meshed with neither the forward gear 71*a* nor the rearward gear 71*b*.

In order to realize the gear change, the lower end of the vertical shift 51 that contacts the horizontal shift rod 53 is provided with a component that is shaped in such a manner that a width of the component is gradually narrowed toward a tip end of the component, in which the gradually narrowed portions of the component constitute a plurality of contact surfaces, like the shift cam 53*a*. Therefore, the contact surfaces that contact the shift rod 53 are switched synchronously with the vertical movement of the vertical shift rod 51, so that the horizontal shift rod 53 and the shift cam 53*a* can be displaced horizontally synchronously with the vertical movement of the vertical shift rod 51.

The shift lever 92 and the left shift cam assembly are basically constructed in the same manner as the shift lever 91 and the right shift cam assembly are done, whereby a gear change of the left propeller 62 is realized. Concretely, when the angle of the shift lever 92 is inclined in the direction F, the shift cam 54*a* is synchronously displaced, whereby the forward gear 72*a* and the dog clutch are operatively meshed with each other. When the shift lever 92 is inclined in the direction R, the shift cam 54*a* is synchronously displaced, whereby the rearward gear 72*b* and the dog clutch are operatively meshed with each other. Also, when the angle of the shift lever 92 is maintained at the angle N, the dog clutch is meshed with neither the forward gear 72*a* nor the rearward gear 72*b*.

Incidentally, the remote control system is not limited to the above-mentioned mechanical remote-control system. A hydraulic remote-control system or an electrical remote-control system may be employed. In this case, predetermined hydraulic pressure or electrical signal that is produced in response to the angle change of the shift levers 91, 92 is converted into mechanical movement by an actuator, whereby the cables 93, 94 are displaced by predetermined distances.

Thus, in the embodiment of the present invention, rotation conditions of the propellers 61, 62, the normal rotation directions of which are different from each other, can be controlled for the propellers. Therefore, when the ship's captain intends to cause the marine vessel to be moved forward, the captain may cause the both of the propellers to be rotated in the normal rotation directions and, when the captain intends to cause the marine vessel to be moved rearward, the captain may cause the both of the propellers to be rotated in the reverse directions. Also, when the captain causes the marine vessel to be turned to a right or left direction, the captain may cause one of the propellers to be rotated in the normal rotation direction and bring the other of the propellers to the neutral situation, or may cause the one of the propellers to be rotated in the reverse direction and bring the other of the propellers to the neutral situation. Moreover, when the captain causes the marine vessel to be swung around on the spot, the captain may cause the one of the propellers to be rotated in the normal rotation direction and cause the other of the propellers to be rotated in the reverse direction.

(2) Second Embodiment

Figure 6:
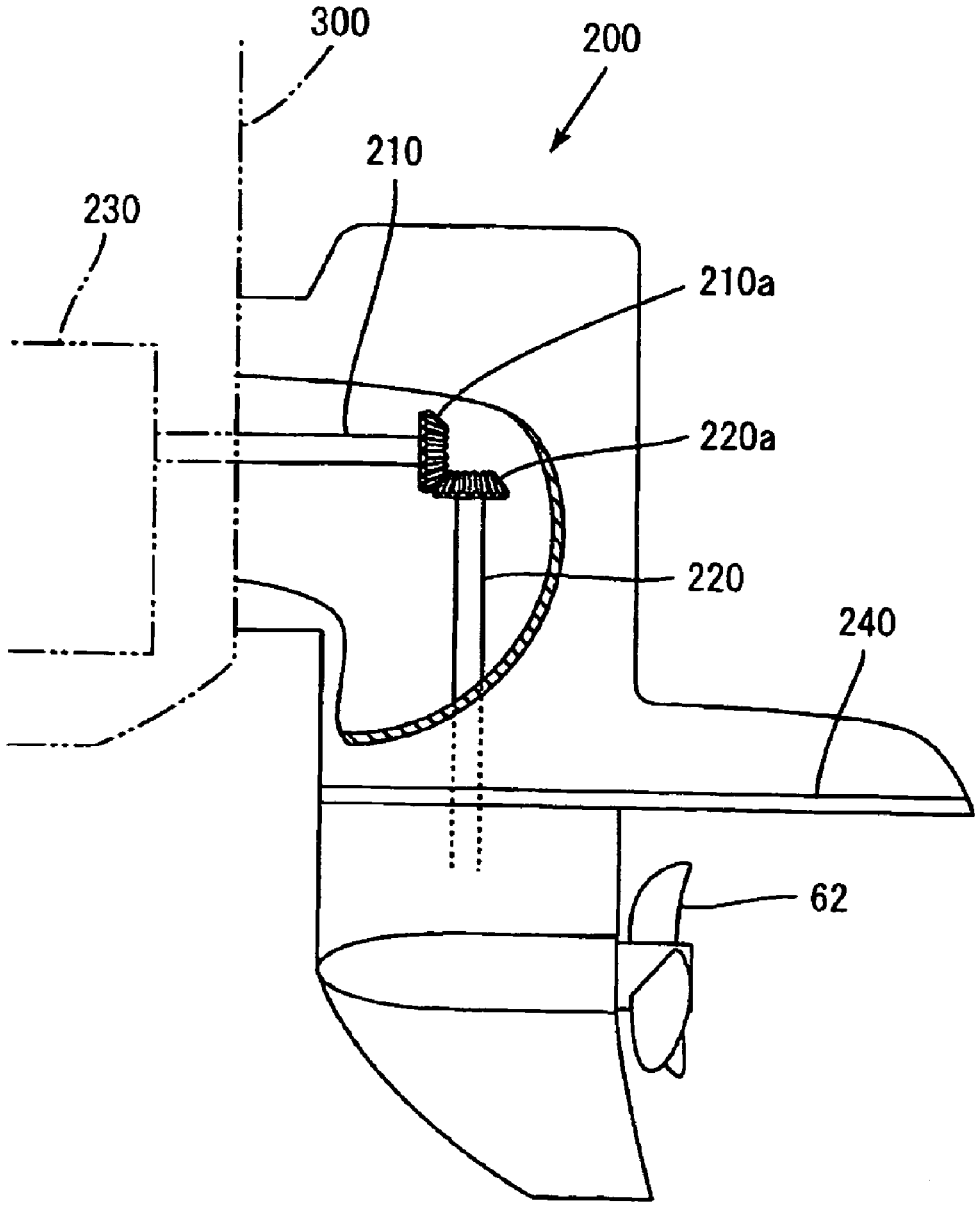
FIG. 6 is a schematic side elevational view of an inboard-outboard drive according to the present invention, in which a part of the inboard-outboard drive illustrated in perspective.

FIG. 6 is a schematic view of an inboard-outboard drive corresponding to a marine vessel driving apparatus of the present invention, in which a part of the inboard-outboard drive is illustrated in perspective.

Unlike the above-mentioned outboard drive 100, the inboard-outboard drive 200 has an engine 230 installed in a predetermined location of an interior of a marine vessel 300 and a drive unit that includes propellers and arranged outboard. Moreover, like the outboard drive 100, the inboard-outboard drive 200 is arranged at a rear portion of the marine vessel so as to be well-balanced by causing a vertical center line of the inboard-outboard drive to be aligned with a center location of a longitudinal direction of the marine vessel.

The second embodiment is different from the first embodiment in a structure of a main drive shaft.

The main drive shaft of the inboard-outboard drive 200 comprises a first main drive shaft element 210 that is supported so as to extend substantially horizontally and receives directly power supplied by the engine 230 and is rotated, and a second main drive shaft element 220 that is supported so as to extend substantially vertically and receives power from the first main drive shaft element 210 and is rotated. The first main drive shaft element 210 and the second main drive shaft element 220 respectively have a bevel gear 210*a* and a bevel gear 220*a* provided at one ends thereof which are adjacent each other. The bevel gears 210*a*, 220*a* are meshed with each other, whereby transmission of the power can be realized.

A structure located lower than the second main drive shaft element 220 is constructed in the same manner as the structure arranged lower than the main drive shaft 40 of the first embodiment shown in FIGS. 2 to 4 is done.

That is, while an interior of a section arranged lower than a cavitation plate 240 is not shown in FIG. 6, a lower end of the second main drive shaft element 220 is located in the interior and two sub-drive shafts are arranged about the lower end of the second main drive shaft element, extend from the lower end of the second main drive shaft element toward left and right directions (in a direction vertical relative to a sheet of FIG. 6) and are supported through a differential bevel gear unit. Moreover, two propeller shafts associated with the sub-drive shafts, and two propellers mounted on tip ends of the propeller shafts are provided.

Since FIG. 6 is a view of the inboard-outboard drive 200 as viewed from the abeam, of the two propellers that are exposed to the exterior, only the left propeller 62 that is located short of the sheet of FIG. 6 is shown in FIG. 6. Furthermore, though not shown in FIG. 6, a right shift cam assembly and a left shift cam assembly that are respectively constructed in the same manner as those of the first embodiment are done are provided within the interior of the inboard-outboard drive 200. Operations of the shift cam assemblies are controlled by a remote control system provided in a cockpit, whereby a rotation condition of the right propeller and a rotation condition of the left propeller can be controlled independently from each other.

That is, the structure according to the present invention can be applied to an inboard-outboard drive that comprises a single engine carried inboard and a drive unit exposed to the outboard.

Incidentally, when viewed in that the left and right propellers are rotated by the power supplied from the single engine, the present invention can be regarded as an invention that is directed to not only the outboard drive 100 or the inboard-outboard drive 200 but also a component called "low casing assembly". That is, the lower section of the main drive shaft which is arranged lower than the lower casing 30 shown in FIG. 1 and the cavitation plate 240 of FIG. 6, and the left and right structures arranged about the lower section of the main drive shaft can be regarded as characteristic components.

The above-mentioned lower casing assembly is useful as a component that can be exchanged for a part of the conventional outboard drive or inboard-outboard drive provided with the single engine and the single drive shaft connected to the single engine. That is, if the lower casing assembly is exchanged for the lower section of the conventional outboard drive or the like and the left and right shift cam assemblies are connected to the cockpit, it is possible to realize the marine vessel to which the structure of the present invention is applied with simple operation and at a low cost, without the exchange of a new outboard drive or the like for the entire outboard drive or the like of the conventional marine vessel.

(3) Summary

As discussed above, according to the present invention, the power supplied from the single engine is transmitted to the left and right directions, and the left propeller and right propeller that face the travel direction of the marine vessel and are respectively arranged at the left and right locations where are spaced apart from the center of the marine vessel at equal distances are finally rotated. In addition, the rotation situation of the left propeller and the rotation situation of the right propeller which include the normal rotation, the reverse rotation and the neutral situation can be controlled independently from each other. In this way, the rotation situations of the respective propellers can be controlled independently from each other, whereby it is possible to precisely realize the movement of the marine vessel that includes the turning-around of the marine vessel and the swinging-around of the marine vessel on the spot, and it is possible to considerably improve maneuverability of the marine vessel as compared with the turning-around of the marine vessel etc. that was conventionally performed with skill and with resort to the thrust generated by the propellers mounted on the single shaft arranged on the center line of the marine vessel, and with resort to the handling of a rudder. Therefore, it is also possible to delicately steer the marine vessel in a narrow harbor.

Meanwhile, there is a possibility that the marine vessel will list to port or starboard due to torques which rotate the propellers. However, in the structure to which the present invention is applied, the normal rotation directions of the left and right propellers are opposite to each other, so that the torques to rotate the respective propellers are opposite to each other. Therefore, when the marine vessel is moved forward and rearward, the marine vessel is prevented from listing to port or starboard and well-balanced, so that it is possible to increase the speed of the marine vessel, without allowing the marine vessel to be exposed to useless water resistance.

Moreover, generally, when propellers are rotated at high speed in the water, if the speed of the rotation is increased to a certain level, vacuum conditions are brought about around the propellers and further speed-up of the marine vessel is therefore prevented. That is, even if the marine vessel is sped up by the increasing of the rotating speed of the propellers, the speed-up of the marine vessel is limited. However, the marine vessel provided with the structure according to the present invention is traveled by propulsive power produced by the two propellers, so that it is possible to produce synthetically enough propulsive power without increasing the rotation peed of one propeller to an upper limit. Therefore, the travel speed of the marine vessel can be increased.

Moreover, the right propeller and the left propeller are driven by the single engine in the structure according to the present invention, so that the following effects can be obtained by the present invention when compared with the case where the two outboard drives or two inboard-outboard drives which have each the single engine and the propellers mounted on the single shaft as a set as in the prior art structure are employed.

Incidentally, generally, it is not preferable to make a comparison of various effects obtained by engines, according to only the number of the employed engines. Therefore, the description of the comparison will be given hereinafter regarding the case of the total horsepower between the engines being equal, such as a case where the outboard drive according to the present invention is constructed by employing a single engine of a large horsepower, for example, a 250 hp engine or a 300 hp engine (condition 1) and a case where the conventional two outboard drives each of which includes an engine having a horsepower that is the half of the large horsepower are employed (condition 2).

First of all, a comparison between the condition 1 and the condition 2 shows that it is possible to save the consumption of fuel requiring for driving the marine vessel in the condition 1. This is judged from the fact that, generally, even if the horsepower of a first engine is the half of the horsepower of a second engine, the consumption amount of fuel required for the first engine will be not decreased to the half of the consumption amount of fuel required for the second engine.

Similarly, even if the horsepower of the first engine is the half of that of the second engine, the weight of an outboard drive in itself will not be halved. Therefore, in the condition 2, the weight of the rear portion of the marine vessel is increased, whereby quick consumption of fuel is progressed.

Secondly, the weighting of the rear portion of the marine vessel as in the condition 2 is avoided in the condition 1, so that, in the condition 1, it is possible to avoid problems that the rear portion of the marine vessel sinks more down than a forward portion of the marine vessel and the balance of the marine vessel becomes poor, and a specific step to compensate the poor balance is required. Therefore, it is possible to easily accomplish compatibility between a large horsepower of the marine vessel and a good balance of the marine vessel.

Thirdly, the comparison between the condition 1 and the condition 2 also shows that the condition 1 facilitates lowering of the maintenance cost of the marine vessel. This is judged from the fact that even if the horsepower of the first engine is the half of that of the second engine, the maintenance cost of the first engine will not be decreased to the half of the maintenance cost of the second engine.

Fourthly, the condition 1 facilitates speeding-up of the marine vessel as compared with the condition 2. Water resistance is generally large in the water. Therefore, in order to speed up the marine vessel, it is necessary to cause the propellers to be rotated by large torques, to thereby produce propulsive power. In the condition 2, each engine has a low horsepower and the torque is low, so that propulsive power generated by each propeller is also low. On the other hand, in the condition 1, the engine has a large-horsepower, whereby the propellers can be rotated by large torque. Therefore, the condition 1 facilitates producing of strong propulsive power by the propellers and facilitates increasing of the travel speed of the marine vessel. Of course, the point that the weight of the entire marine vessel in the condition 1 is lighter than that of the entire marine vessel in the condition 2 is the factor that allows the travel speed of the marine vessel to be increased.

The terms and expressions which have been employed herein are used as terms of description, not of limitation. There is not limitation in the use of such terms and expressions of excluding any equivalents of the features shown and described or portions thereof. However, it is recognized that various modifications are possible within the scope of the invention claimed.

What is claimed is:

1. A propulsion structure for a marine vessel, comprising:

an outboard propulsion unit for coupling with an exterior aft section of the marine vessel, the outboard propulsion unit includes:

a housing;

the housing is comprised of a top cowling that houses an engine, an upper casing that constitutes a mid-section of the housing, and a lower casing that is substantially positioned lower than a bottom of the marine vessel;

a vertically oriented main drive shaft disposed within the housing and coupled with the engine, and having a length that extends from the top cowling to the lower casing of the housing, the vertically oriented main drive shaft receives predetermined power from the engine and rotates;

the vertically oriented main drive shaft includes a lower end housed within the lower casing of the housing;

horizontally oriented sub-drive shafts housed within the lower casing of the housing, and disposed in several directions relative to the vertically oriented main drive shaft;

horizontally oriented sub-drive shafts include a horizontally oriented left sub-drive shaft with a first right end and a horizontally oriented right sub-drive shaft with a first left end, with the first right end and the first left end of the respective horizontally oriented left sub-drive shaft and the horizontally oriented right sub-drive shaft coupled with the lower end of the vertically oriented main drive shaft, and extending in a respective horizontally oriented left and right directions;

a power transmission mechanism disposed within the lower casing of the housing for transmitting power from the vertically oriented main drive shaft to the horizontally oriented left sub-drive shaft and the horizontally oriented right sub-drive shaft and rotating the horizontally oriented sub-drive shafts by the transmitted power;

propeller shafts disposed within the lower casing of the housing and oriented in rearward and forward moving direction of the marine vessel, and associated with the horizontally oriented sub-drive shafts;

the propeller shafts include a left propeller shaft coupled with a second left end of the horizontally oriented left sub-drive shaft, and a right propeller shaft coupled with a second right end of the horizontally oriented right sub-drive shaft;

propellers mounted on the propeller shafts;

with a right propeller mounted on the right propeller shaft and a left propeller mounted on the left propeller shaft;

a propeller rotating mechanism disposed within the lower casing of the housing for transmitting the power transmitted to the horizontally oriented sub-drive shafts to the propeller shafts and the propellers, to thereby cause the propellers to rotate; and shift cam assembly disposed within the lower casing of the housing for changing rotation situations of the propellers independently from each other, with the shift cam assembly having a control located external to the housing of the outboard propulsion;

the shift cam assembly is comprised of right shift cam assembly and a left shift cam assembly unit;

the right shift cam assembly is comprised of a right vertical shift rod coupled with a right horizontal shift rod, with the right horizontal shift rod coupled with a right shift cam;

the left shift cam assembly is comprised of a left vertical shift rod coupled with a left horizontal shift rod, with the left horizontal shift rod coupled with a left shift cam;

the right vertical shift rod independently moving vertically by the external shift cam assembly control, and the left vertical shift rod independently moving vertically by the external shift cam assembly control;

the right and left horizontal shift rods are supported substantially at a same height of the respective right and left horizontally oriented sub-drive shafts;

the right horizontal shift rod and the right shift cam are displaced horizontally and synchronously with the vertical movement of the right vertical shift rod;

the left horizontal shift rod and the left shift cam are displaced horizontally and synchronously with the vertical movement of the left vertical shift rod;

with the rotation situation of the right propeller changed independent of the rotation situation of the left propeller by the independent displacement of the respective right and left shift cams.

2. A propulsion structure for a marine vessel according to claim 1, wherein the vertically oriented main drive shaft is provided at the lower end with a bevel gear and the horizontally oriented sub-drive shafts are provided with bevel gears at portions thereof which are adjacent the vertically oriented main drive shaft, the bevel gears of the horizontally oriented sub-drive shafts being meshed with the bevel gear of the vertically oriented main drive shaft.

3. A propulsion structure for a marine vessel according to claim 1, wherein two propellers are arranged at locations spaced apart in left and right directions from the vertically oriented main drive shaft at approximately equal distances, with the propeller shafts thereof extending in substantially parallel with each other, and the propellers are of opposite pitch with normal rotation for advancing the marine vessel that are opposite to each other.

4. A propulsion structure for a marine vessel according to claim 1, further including a forward gear for causing corresponding propeller to be rotated in a normal rotation direction and a rearward gear for causing corresponding propeller to be rotated in a reverse direction, the forward and rearward gears are arranged between corresponding horizontally oriented sub-drive shaft and propeller shaft, with the shift cam assembly to execute switching to cause one of an activation and inactivation of one of the forward and rearward gears.

5. A marine vessel driving apparatus, comprising:

an outboard propulsion unit for coupling with an exterior aft section of the marine vessel, the outboard propulsion unit includes:

a housing;

the housing is comprised of a top cowling that houses an engine for generating predetermined power, an upper casing that constitutes a mid-section of the housing, and a lower casing that is substantially positioned lower than a bottom of the marine vessel;

a vertically oriented main drive shaft disposed within the housing and rotated by the power generated by the engine and transmit the power in several directions relative to the vertically oriented main drive shaft;

vertically oriented main drive shaft having a length that extends from the top cowling to the lower casing of the housing, and includes a lower end housed within the lower casing;

horizontally oriented sub-drive shafts disposed within the lower casing of the housing and arranged in the several directions;

horizontally oriented sub-drive shafts include a horizontally oriented left sub-drive shaft with a first right end and a horizontally oriented right sub-drive shaft with a first left end, with the first right end and the first left end of the respective horizontally oriented left sub-drive shaft and the horizontally oriented right sub-drive shaft coupled with the lower end of the vertically oriented main drive shaft, and extending in a respective horizontally oriented left and right directions;

a power transmission mechanism disposed within the lower casing of the housing for causing the horizontally oriented sub-drive shafts to rotate by the power transmitted in the several directions;

propeller shafts disposed within the lower casing of the housing and a right propeller and a left propeller associated with the respective horizontally oriented right and left sub-drive shafts;

the propeller shafts include a left propeller shaft coupled with a second left end of the horizontally oriented left sub-drive shaft, and a right propeller shaft coupled with a second right end of the horizontally oriented right sub-drive shaft;

a propeller rotating mechanism disposed within the lower casing of the housing for transmitting the power transmitted to the horizontally oriented sub-drive shafts to the propeller shafts and the propellers and rotating the propellers; and shift cam assembly disposed within the lower casing of the housing for changing rotation situations of the propellers independently from each other, with the shift cam assembly having a control located external to the housing of the outboard propulsion unit the shift cam assembly is comprised of right shift cam assembly and a left shift cam assembly;

the right shift cam assembly is comprised of a right vertical shift rod coupled with a right horizontal shift rod, with the right horizontal shift rod coupled with a right shift cam;

the left shift cam assembly is comprised of a left vertical shift rod coupled with a left horizontal shift rod, with the left horizontal shift rod coupled with a left shift cam;

the right vertical shift rod independently moving vertically by the external shift cam assembly control, and the left vertical shift rod independently moving vertically by the external shift cam assembly control;

the right and left horizontal shift rods are supported substantially at a same height of the respective right and left horizontally oriented sub-drive shafts;

the right horizontal shift rod and the right shift cam are displaced horizontally and synchronously with the vertical movement of the right vertical shift rod;

the left horizontal shift rod and the left shift cam are displaced horizontally and synchronously with the vertical movement of the left vertical shift rod;

with the rotation situation of the right propeller changed independent of the rotation situation of the left propeller by the independent displacement of the respective right and left shift cams.

6. A marine vessel driving apparatus comprising:

an propulsion unit for coupling with an exterior aft section of the marine vessel, the outboard propulsion unit includes:

a housing;

the housing is comprised of a top cowling that houses a single engine, an upper casing that constitutes a mid-section of the housing, and a lower casing that is substantially positioned lower than a bottom of the marine vessel;

the single engine is for generating predetermined power;

a vertically oriented main drive shaft disposed within the housing and rotated by the power generated by the engine;

the vertically oriented main drive shaft having a length that extends from the top cowling to the lower casing of the housing, and includes a tip end housed within the lower casing, and provided at the tip end thereof with a bevel gear;

two horizontally oriented sub-drive shafts disposed within the lower casing of the housing and provided so as to respectively extend in left and right directions from a location adjacent the tip end of the vertically oriented main drive shaft;

the two horizontally oriented sub-drive shafts having bevel gears which are provided at ends thereof adjacent the tip end of the vertically oriented main drive shaft and meshed with the bevel gear of the vertically oriented main drive shaft;

left and right propeller shafts connected to the other ends of the horizontally oriented sub-drive shafts and provided so as to extend in substantially parallel with each other disposed within the lower casing of the housing and oriented in rearward and forward moving direction of the marine vessel;

left and right propellers respectively provided at tip ends of the left and right propeller shafts;

the left and right propellers being designed such that their normal rotation directions for forward movement are opposite to each other;

forward gears and rearward gears provided at the respective propeller shafts;

pinion gears provided at the other ends of the sub-drive shafts;

the forward gears and rearward gears being meshed with the pinion gears provided at corresponding sub-drive shafts;

the forward gears being designed so as to be rotated in a normal rotation direction;

the rearward gears being designed so as to be rotated in a reverse direction;

left and right clutches adapted to be operatively connected to the forward gears or the rearward gears and transmit the power of corresponding sub-drive shafts to the propeller shafts and the propellers; and left and right shift cam assemblies are disposed within the lower casing of the housing and are control external to the housing to change rotation situations of the propellers independently from each other by switching positions of the left and right clutches, at which the left and right clutches are operatively connected to the forward gears and operatively connected to the rearward gears, and connected to neither the forward gears nor the rearward gears, in such a manner that the positions of the left and right clutches are switched independently from each other the shift cam assembly is comprised of right shift cam assembly and a left shift cam assembly;

the right shift cam assembly is comprised of a right vertical shift rod coupled with a right horizontal shift rod, with the right horizontal shift rod coupled with a right shift cam;

the left shift cam assembly is comprised of a left vertical shift rod coupled with a left horizontal shift rod, with the left horizontal shift rod coupled with a left shift cam;

the right vertical shift rod independently moving vertically by the external shift cam assembly control, and the left vertical shift rod independently moving vertically by the external shift cam assembly control;

the right and left horizontal shift rods are supported substantially at a same height of the respective right and left horizontally oriented sub-drive shafts;

the right horizontal shift rod and the right shift cam are displaced horizontally and synchronously with the vertical movement of the right vertical shift rod;

the left horizontal shift rod and the left shift cam are displaced horizontally and synchronously with the vertical movement of the left vertical shift rod;

with the rotation situation of the right propeller changed independent of the rotation situation of the left propeller by the independent displacement of the respective right and left shift cams.

* * * * *